US008042301B2

(12) United States Patent
Ritter

(10) Patent No.: US 8,042,301 B2
(45) Date of Patent: Oct. 25, 2011

(54) FLAP DRIVE

(75) Inventor: Andreas Ritter, Hilgert (DE)

(73) Assignee: Stabilus GmbH, Koblenz (DE)

( * ) Notice: Subject to any disclaimer, the term of this patent is extended or adjusted under 35 U.S.C. 154(b) by 1166 days.

(21) Appl. No.: 11/818,928

(22) Filed: Jun. 15, 2007

(65) Prior Publication Data

US 2007/0289397 A1 Dec. 20, 2007

(30) Foreign Application Priority Data

Jun. 16, 2006 (DE) ..... 10 2006 027 857

(51) Int. Cl.
*E05F 11/24* (2006.01)

(52) U.S. Cl. ..... 49/343; 49/139; 49/340

(58) Field of Classification Search ..... 49/340, 49/339, 342, 343, 344, 341, 139, 140, 324
See application file for complete search history.

(56) References Cited

U.S. PATENT DOCUMENTS

| | | | | |
|---|---|---|---|---|
| 2,371,336 | A * | 3/1945 | Levon | 49/340 |
| 4,186,524 | A * | 2/1980 | Pelchat | 49/324 |
| 5,140,771 | A * | 8/1992 | Moy et al. | 49/340 |
| 5,687,507 | A * | 11/1997 | Beran | 49/340 |
| 6,055,776 | A * | 5/2000 | Dettling et al. | 49/341 |
| 6,202,350 | B1 * | 3/2001 | Montgomery et al. | 49/139 |
| 6,430,871 | B1 * | 8/2002 | Hebda | 49/340 |
| 6,446,390 | B1 * | 9/2002 | Bandemer et al. | 49/324 |
| 6,694,675 | B1 * | 2/2004 | Craft et al. | 49/339 |
| 6,883,275 | B2 * | 4/2005 | Hellinga et al. | 49/345 |
| 6,962,023 | B2 * | 11/2005 | Daniels et al. | 49/342 |
| 7,377,075 | B2 * | 5/2008 | Oberheide | 49/139 |
| 7,500,711 | B1 * | 3/2009 | Ewing et al. | 296/146.4 |
| 7,556,304 | B2 * | 7/2009 | Buescher | 296/56 |
| 7,566,092 | B2 * | 7/2009 | Paton et al. | 296/146.8 |
| 2002/0148164 | A1 * | 10/2002 | Bandemer et al. | 49/324 |
| 2006/0075684 | A1 * | 4/2006 | Hansch et al. | 49/340 |
| 2006/0094562 | A1 | 5/2006 | Kleinmann et al. | |
| 2007/0262609 | A1 * | 11/2007 | King et al. | 296/146.8 |

FOREIGN PATENT DOCUMENTS

| | | | |
|---|---|---|---|
| DE | 43 22 133 | | 1/1995 |
| DE | 102 27 915 | | 1/2004 |
| GB | 2161540 | A * | 1/1986 |
| GB | 2169652 | A * | 7/1986 |

OTHER PUBLICATIONS

Examination Report dated Feb. 9, 2007 issued for the corresponding German Application No. 10 2006 027 857.7-23.

* cited by examiner

*Primary Examiner* — Jerry Redman
(74) *Attorney, Agent, or Firm* — Cozen O'Connor

(57) ABSTRACT

A drive train for a pivotable flap of a motor vehicle includes a holding device which can hold the flap in at least one open position, a first element which can be driven by a drive motor, and a second element connected to the pivotable flap to pivot the flap in response to movement of the first element. When the second element is moved along a path of motion relative to the first element counter to a specific spring force, a sensor generates a signal indicating relative motion of the elements, and a control device releases the holding device in response to the signal, whereby the flap can be moved manually by applying a force counter to the spring force.

19 Claims, 3 Drawing Sheets

FLAP DRIVE

BACKGROUND OF THE INVENTION

1. Field of the Invention

The invention relates to a flap drive, in particular for a flap of a motor vehicle, with a drive train including a drive motor and a plurality of elements leading to a component of the flap which is pivotable about a pivot axis. The flap can be held in one or more open positions by a holding device, and when acted upon by manual force is at least substantially freely movable in the opening and/or closing direction.

2. Description of the Related Art

With such flap drives, it is necessary to hold the flap, without expending energy, in an intermediate position or in the fully open position against its own weight or against excessive forces of the counter balancing used for the flap, a manual mobility of the flap always having to be provided.

With such a flap drive it is known that an application of manual force on the flap is detected by a force sensor or torque sensor.

SUMMARY OF THE INVENTION

It is the object of the invention to provide a flap drive of the aforementioned type which, with a simple construction, allows a detection of an application of manual force on the flap with a high degree of reliability.

This object is achieved according to the invention by at least two elements of the drive train being movable relative to one another counter to a specific spring force, in the force transmission flow of the drive train. The path of motion of the two elements relative to one another can be detected by a sensor and a control signal can be generated, which may be supplied to a control device, by means of which the holding device may be releasably activated.

If the manual forces required for the manual motion of the flap exceed the permissible values, optionally according to the wishes of the operator, this is detected by the sensor and then a corresponding action is initiated which allows a manual motion of the flap with the permissible manual forces.

As not only a specific actuating force has to be applied, therefore, but also a switching motion has to be carried out, the probability of false tripping is low.

Actions which can be initiated, in addition to the release of the holding device, are for example also an activation of the drive motor at the start of the drive in the desired direction of motion, resulting only in an initiation of the motion by the drive motor rather than a fully motorized sequence of motion.

The specific spring force, exceeding which the action is triggered, may be an absolute fixed spring force. It is, however, possible that this spring force is variable relative to the retaining forces required for holding the flap in the respective open position.

In this connection, the applied manual forces are not directly registered by the spring force but indirectly registered.

The holding device may be a braking device arranged in the drive train and which may be activated by the control device.

A further possibility for releasing a holding device with a flap drive without braking is that the drive motor or a part of the drive train is self-locking and a disconnect coupling is arranged in the drive train, by means of which the drive train, when activated by the control device, may be separated into a first self-locking partial drive train and a second non-self-locking partial drive train leading to the flap.

According to the type of drive for pivoting the flap, a relative linear path of motion or a relative rotational path of motion of the two elements to one another may be detected by the sensor.

If the path of motion from a normal position into a direction of motion is able to be detected by the sensor, a triggering of the release of the holding device is only carried out by manual actuation of the flap in a specific pivoting direction.

If the path of motion from a normal position into two directions of motion opposing one another may be detected by means of the sensor, the flap may be optionally actuated manually in the one or the other pivoting direction, in order to trigger a release of the holding device.

The sensor for detecting the relative motion may, for example, be a potentiometer detecting the relative motion of the two elements.

It is, however, particularly advantageous if the sensor is a Hall sensor, past which one or more magnets may be moved relative to one another, or if the sensor is an optical sensor, an inductive sensor or a capacitive sensor, as these sensors detect the relative motion in a contact-free manner.

In order to be able to be easily activated by an electrical signal generated by the control device, the drive motor is an electric motor.

A lower overall depth results if one of the two elements is a drive part which may be driven by the drive motor in a linear manner or in a rotationally movable manner, of which the motion oriented in a first direction of motion may be transmitted via a first spring with the specific spring force to the second movable element leading to the flap. The motion of the element leading to the flap relative to the movable drive part can be detected by the fixedly arranged sensor.

In order to be able to detect a manual actuation in both pivoting directions, a motion of the drive part oriented in a second direction of motion oriented counter to the first direction of motion may, therefore, be transmitted via a second spring with a specific spring force to the second movable element leading to the flap.

In this connection, the spring forces of the two springs may be the same or even of different strengths depending on the pivoting direction.

Simple embodiments of the springs are that one or more of the springs are compression springs, in particular helical compression springs or, however, elastomeric components.

An integral construction only requiring little constructional space results if the linearly movable drive part has a support part displaceably guided in a cage of the linear moveable element leading to the flap in the first and/or second direction of motion. The first spring and/or the second spring is axially supported with its one end on the support part and with its other end on the cage.

In this connection, the motion is detected in a simple contact-free manner by the fact that a magnet or a series of magnets with alternating poles are arranged on the cage or on the movable element leading to the flap. The magnet may be moved past a fixed Hall element in the first and/or second direction of motion, a greater path of motion also being digitally detectable in a simple manner by the series of magnets.

The linearly movable drive part may be a threaded spindle which may be linearly movably driven by a spindle nut which may be rotatably driven by the drive motor.

An integral construction also requiring only a small amount of constructional space is achieved by connecting the rotationally movable drive part via a claw coupling to the rotationally movable element leading to the flap, the first and/or second spring being arranged in the radial peripheral direction between the claws of the drive part and the claws of the rotationally movable element.

Preferably, therefore, the claw recesses of one side of the claw coupling are larger in the radial peripheral direction than the claws of the other side of the claw coupling engaging therein, the springs being arranged in the gaps between the walls of the claw recesses and the claws. These springs are, therefore, preferably elastomeric components.

A simple detection of the motion in a contact-free manner is carried out by a magnet or a series of magnets with alternating poles in the radial peripheral direction being arranged on the rotationally movable element leading to the flap, and which may be moved past a fixed Hall element in the first and/or second direction of motion.

In this connection, the rotationally movable element leading to the flap may include a driving pinion which carries the axially oriented magnet(s) and engages in a toothed wheel which is fixedly arranged on a flap shaft extending coaxially to the pivot axis and to which the flap is fastened with its one edge region.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
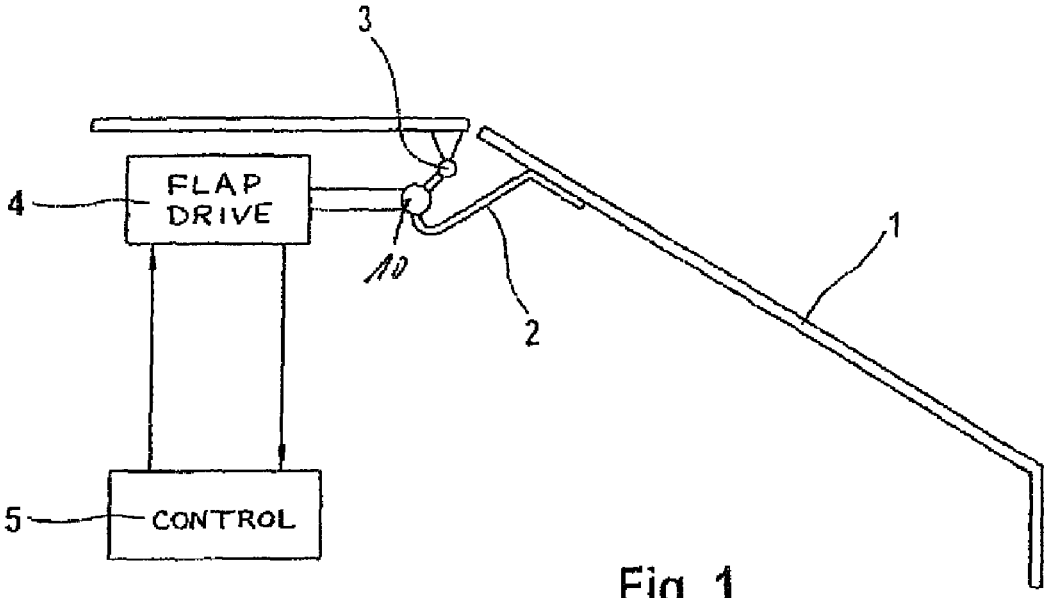
FIG. 1 is a schematic side view of a detail of a motor vehicle rear region with a flap drive.

A flap 1 is shown in FIG. 1, which is a tailgate of a motor vehicle and which is pivotable via a link part 2 about a pivot axis 3. The pivot axis 3 extends along an aperture of the bodywork of the motor vehicle on the roof side which may be closed by the flap 1.

The link part 2 may be impinged upon by a linearly movable element of a flap drive 4 at a radial distance from the pivot axis 3, transversely to the extension of the pivot axis 3.

The flap 1 pivoted out of its closed position into an open position remains in this open position, held by a holding device, as long as the holding device is not releasably activated by an electrical control device 5.

Figure 2:
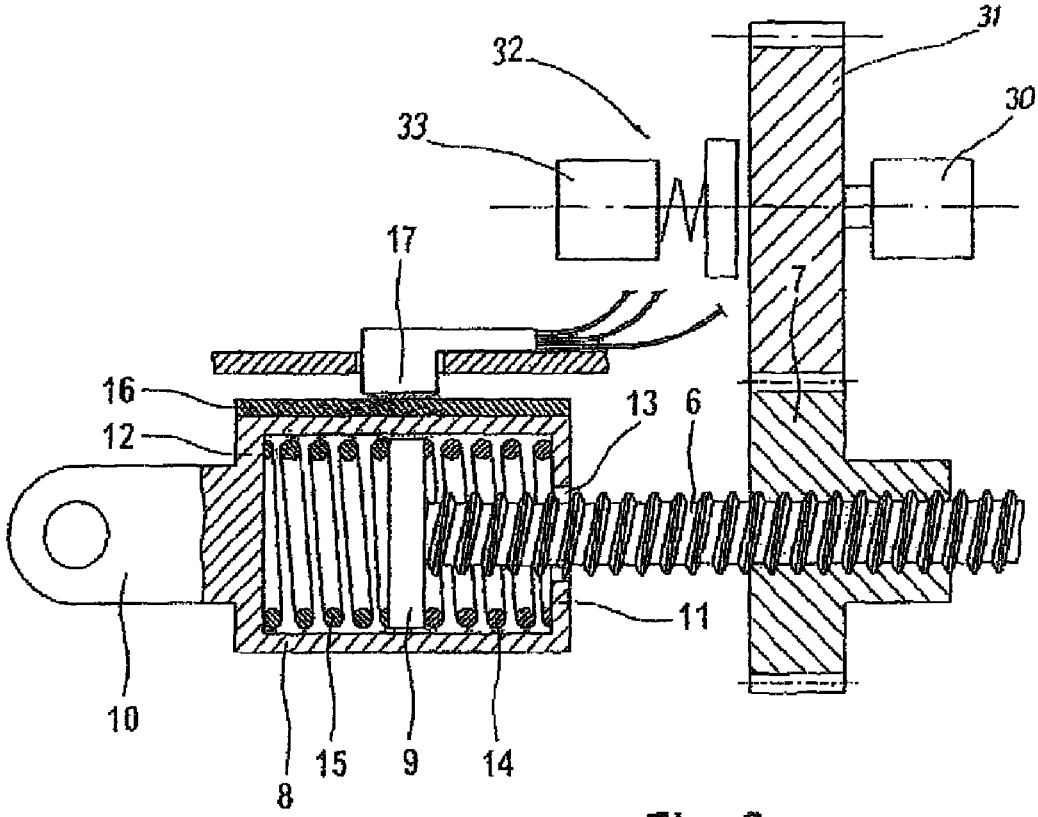
FIG. 2 is a section view of a first embodiment of a flap drive.

The flap drive 4 shown in FIG. 2 includes a threaded spindle 6 forming a linearly movable drive part and secured against rotation, which is driven in a linearly movable manner by a spindle nut 7 which may be rotatably driven by an electric motor 30 and a drive pinion 31.

The threaded spindle 6 projects with its one end into a cylindrical cage 8 and carries at this end a disc-like support part 9.

The cage 8 is a part of a linearly movable element 10 leading to the flap 1, by which the link part 2 of the flap 1 may be pivotally acted upon.

The cage 8 is closed at its two ends by terminal walls 11 and 12, the terminal wall 11 on the spindle side has a through-passage 13 through which the threaded spindle is guided.

Two helical compression springs 14 and 15 are arranged in the cage 8. The first helical compression spring 14 is supported with its one end on the one side of the support part 9 and with its other end on the terminal wall 11 on the spindle side, whilst the second helical compression spring 15 is supported with its one end on the second side of the support part 9 and with its other end is supported on the support wall 12 facing the element 10.

In the normal position shown, in which the support part 9 is located in a central position in the cage 8, the force is equalized between the two helical compression springs 14 and 15.

On the outer peripheral surface of the cage 8 a magnetic strip 16 is arranged, extending in the longitudinal extension direction of the cage 8 and which comprises a series of alternating poles.

In the vicinity of the magnetic strip 16, a Hall element 17 is fixedly arranged in the central region thereof which may be controlled by the magnetic fields of the poles and the signals thereof are supplied to the control unit 5.

With a rotary drive of the spindle nut 7 by the reversible electric motor, the threaded spindle 6 moves independently of the respective rotational direction of the spindle nut 7 axially in a first direction of motion or in a second direction of motion counter to the first direction of motion and, therefore, opens or closes the flap 1.

The two helical compression springs 14 and 15 are sufficiently strong, therefore, to hold the support part 9 in its normal position, as shown.

The Hall element 17 supplies an unmodified signal to the control unit 5.

The support part 9 also remains in this normal position if the flap is held in an intermediate open position or a fully open position.

If the flap 1 is now manually acted upon by force, this force acts axially on the element 10. As the threaded spindle 6 and thus the support part 9 are fixed, the element 10 and the cage 8 therewith are displaced by compressing one of the helical compression springs 14 and 15.

By the displacement of the cage 8, the magnetic strip 16 also travels past the fixed Hall element 17, which detects the magnetic fields of the poles travelling past and supplies a corresponding position signal and direction signal to the control device 5.

Between the electric motor 30 and the spindle nut 7 a braking device 32 is present, which is actuated when the flap adopts an open position according to an adjusting drive and blocks the drive train by the electric motor 30 from the electric motor 30 to the flap 1. As a result, the flap 1 is held in the adopted open position. The braking device 32 is actuatable by an electromagnet 33. In the closed position of the braking device 32, a rotation of drive pinion 31 is blocked.

If, as disclosed above, the flap 1 is now manually acted upon by force and a corresponding position signal and direction signal are supplied to the control device 5, the control device 5 activates the electromagnet 33 of the braking device 32 such that the braking device is released.

Thus the flap 1 may be manually moved by moderate manual forces.

After the manual impingement of the flap 1 has been completed, the cage 8 is again moved into its normal position by the helical compression springs 14 and 15. This is detected by the Hall element 17 and a corresponding signal supplied to the control device 5, which, in turn, activates the braking device in the closed position.

Figure 3:
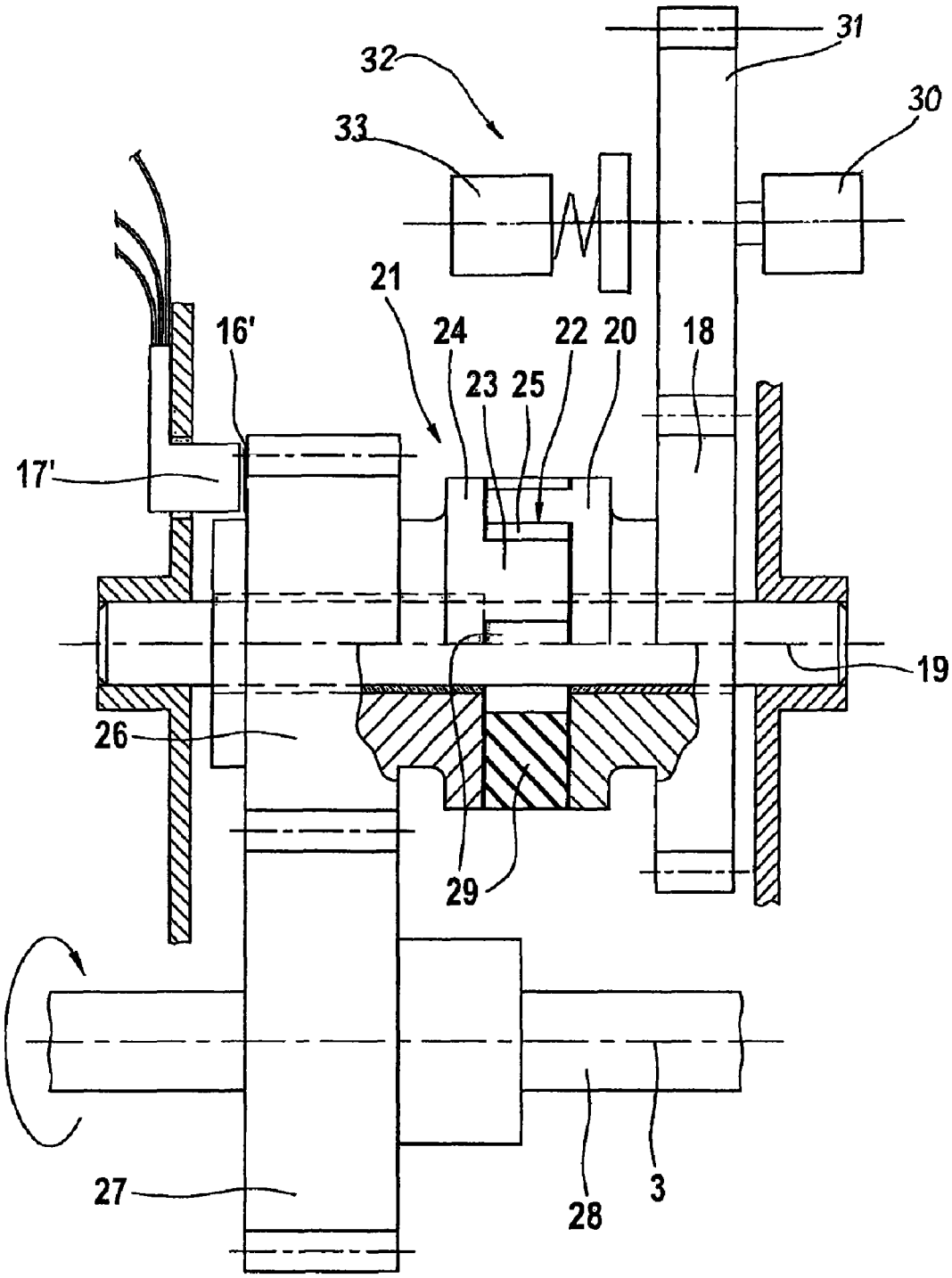
FIG. 3 is a section view of a side view of a second embodiment of a flap drive.

In the embodiment of FIG. 3, a first toothed wheel 18 of a rotationally movable drive part may be rotatably driven about a drive axis 19 by a drive pinion 31 of an electric motor 30. Between the electric motor 30 and the first toothed wheel 18*a* there is a braking device 32 as shown in FIG. 2.

A first claw part 20 of a claw coupling 21 is coaxially fixedly connected to the toothed wheel 18. The claws 23 of a rotatably mounted second claw part 24 arranged coaxially thereto engage in the claw recesses 22 of the first claw part 20, large gaps being present in the peripheral direction between the claws 23 of the second claw part 24 and the walls of the claw recesses 22 of the first claw part 20, which are filled up by elastomeric components 25 and 29 forming compression springs.

A driving pinion 26 is coaxially fixedly connected to the second claw part 24 of the claw coupling 21 and into which a second toothed wheel 27 engages and which is arranged fixedly on a flap shaft 28. The flap shaft 28 extends coaxially to the pivot axis 3, an edge region of the flap being fastened to the flap shaft 28.

On the one front face of the driving pinion 26, a coaxial arcuate magnetic strip 16' is arranged, which corresponds to the magnetic strip 16 in FIG. 2 to which a Hall element 17' is fixedly arranged in an axially opposing manner, which corresponds to the Hall element 17 in FIG. 2.

The function of the embodiment of FIG. 3 corresponds to the function of the embodiment of FIG. 2.

In this connection, the elastomeric components 25 and 29 in FIG. 3, arranged on both sides of the claws 23, correspond to the two helical compression springs 14 and 15 in FIG. 2.

The relative motion of the two elements of the drive train in FIG. 3 (first claw part 20 and second claw part 24) is rotary, whilst the relative motion in FIG. 2 of the two elements of the drive train (threaded spindle 6 and element 10) is linear.

Figure 4:
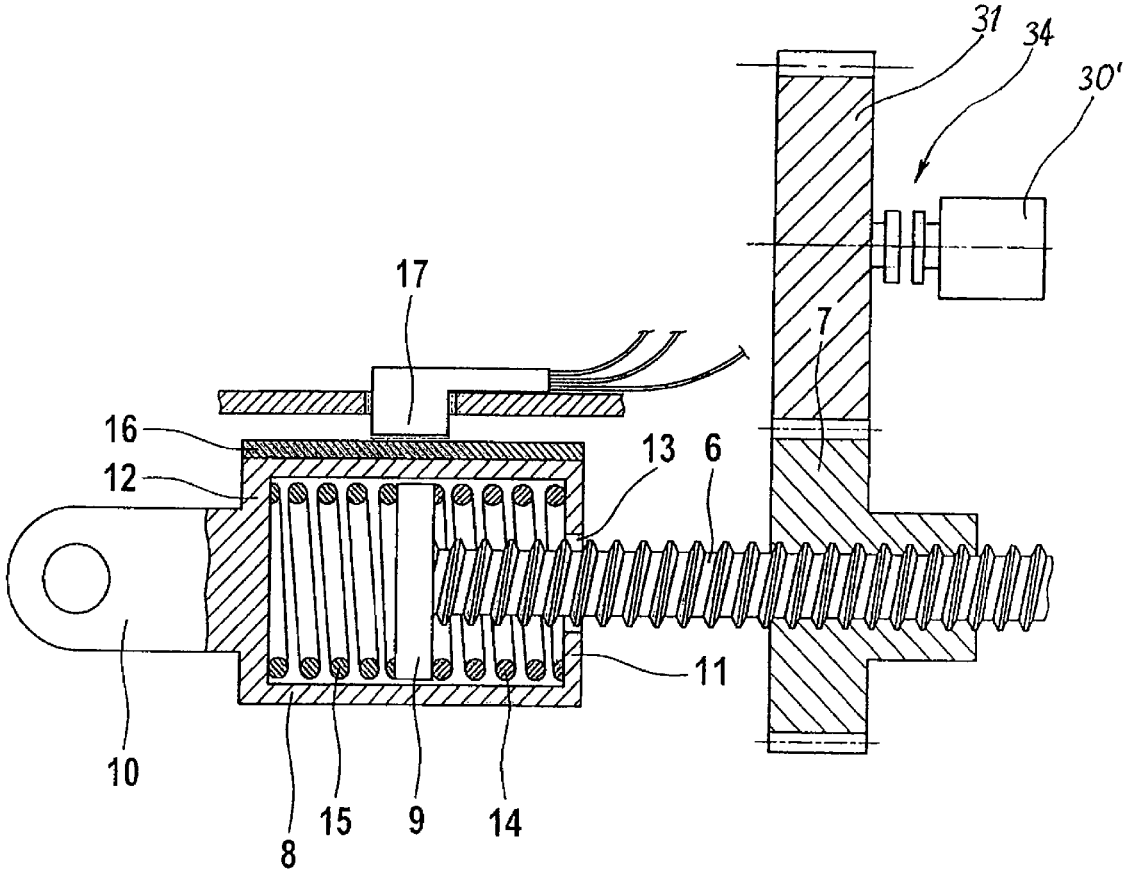
FIG. 4 shows a third embodiment of a flap drive in cross-section.

The embodiment of FIG. 4 corresponds largely to the embodiment of FIG. 2. In difference to FIG. 2 there is no braking device. Instead a braking device there is a disconnect coupling 34 disposed between the self-locking electric motor 30' and the drive pinion 31. The disconnect coupling may be controlled by the electrical control device 5 and the electric motor 30' separated from the drive pinion 31.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A drive train configured to drive a pivotable flap of a motor vehicle, the drive train comprising:

a holding device configured to hold the flap in at least one open position;

a first element which can be driven by a drive motor;

a second element configured to be connected to the pivotable flap to pivot the flap in response to movement of the first element, wherein the second element can be moved along a path of motion relative to the first element counter to a specific spring force; a sensor which can detect motion of the second element relative to the first element and generate a signal indicating relative motion of said elements; and a control device which releases said holding device in response to said signal indicating relative motion of said elements, whereby said flap can be moved manually by applying a force counter to said spring force.

2. The drive train of claim 1 wherein the holding device is a braking device located between the motor and the first element.

3. The drive train of claim 1 wherein the sensor can detect a path of relative motion in two opposing directions from a normal position.

4. The drive train of claim 3 wherein the sensor comprises a potentiometer.

5. The drive train of claim 3 wherein the sensor comprises a fixed Hall sensor and at least one magnet fixed to said second element.

6. The drive train of claim 3 wherein the sensor is one of an optical sensor, an inductive sensor, and a capacitive sensor.

7. The drive train of claim 1 further comprising a first spring which transmits movement of the first element in a first direction to the second element, said first spring having a specific spring force.

8. The drive train of claim 7 wherein said first spring is a helical compression spring.

9. The drive train of claim 7 further comprising a second spring which transmits movement of the first element in a second direction to the second element, said second direction being opposite to said first direction, said second spring having a specific spring force.

10. The drive train of claim 9 wherein the first and second elements are linearly movable, said drive train further comprising a support element fixed to said first element and a cage fixed to said second element, wherein said support element is linearly movable in said cage, said first and second springs being axially supported on said support element in said cage.

11. The drive train of claim 10 wherein said sensor comprises a fixed Hall sensor and at least one magnet on said cage.

12. The drive train of claim 11 wherein said first element is a spindle which is moved linearly by a spindle nut driven by said drive motor.

13. The drive train of claim 10 wherein said first and second springs are helical compression springs.

14. The drive train of claim 9 wherein the first and second elements are rotationally movable, said drive train further comprising a claw coupling having claws fixed to said first element and claws fixed to said second element, said first and second springs being arranged circumferentially between the claws of the first element and the claws of the second element.

15. The drive train of claim 14 wherein said sensor comprises a fixed Hall sensor and at least one magnet on the second element.

16. The drive train of claim 15 further comprising a flap shaft extending coaxially to a pivot axis of the flap, and a toothed wheel fixed to the flap shaft, the second element comprising a driving pinion which engages the toothed wheel, the at least one magnet comprising axially oriented magnets on the driving pinion.

17. A drive train configured to drive a pivotable flap of a motor vehicle, the drive train comprising:

a holding device configured to hold the flap in at least one open position;

a first element which can be driven by a drive motor;

a second element configured to be connected to the pivotable flap to pivot the flap in response to movement of the first element, wherein the second element can be moved along a path of motion relative to the first element counter to a specific spring force; a sensor which can detect motion of the second element relative to the first element and generate a signal indicating relative motion of said elements; and a control device which releases said holding device in response to said signal indicating relative motion of said elements, whereby said flap can be moved manually by applying a force counter to said spring force, and the holding device comprises a disconnect coupling, said disconnect coupling separating said drive train into a self-locking part connected to said motor and a non-self-locking part connected to the flap.

18. A drive train configured to drive a pivotable flap of a motor vehicle, the drive train comprising:

a holding device configured to hold the flap in at least one open position;

a first element which can be driven by a drive motor;

a second element configured to be connected to the pivotable flap to pivot the flap in response to movement of the first element;

a first spring elastomeric component that transmits movement of the first element in a first direction to the second element, said first elastomeric component having a specific spring force, wherein the second element can be moved along a path of motion relative to the first element counter to a specific spring force;

a sensor which can detect motion of the second element relative to the first element and generate a signal indicating relative motion of said elements; and a control device which releases said holding device in response to said signal indicating relative motion of said elements, whereby said flap can be moved manually by applying a force counter to said spring force.

19. A drive train configured to drive a pivotable flap of a motor vehicle, the drive train comprising:

a holding device configured to hold the flap in at least one open position;

a first element which can be driven by a drive motor;

a second element configured to be connected to the pivotable flap to pivot the flap in response to movement of the first element, wherein the second element can be moved along a path of motion relative to the first element counter to a specific spring force;

a sensor which can detect motion of the second element relative to the first element and generate a signal indicating relative motion of said elements;

a control device which releases said holding device in response to said signal indicating relative motion of said elements, whereby said flap can be moved manually by applying a force counter to said spring force;

a first elastomeric component that transmits movement of the first element in a first direction to the second element, said first elastomeric component having a specific spring force; and a second elastomeric component that transmits movement of the first element in a second direction to the second element, said second direction being opposite to said first direction, said second elastomeric component having a specific spring force, wherein the first and second elements are rotationally movable, said drive train further comprising a claw coupling having claws fixed to said first element and claws fixed to said second element, said first and second springs being arranged circumferentially between the claws of the first element and the claws of the second element.

* * * * *